US006481246B1

(12) United States Patent
Johnson et al.

(10) Patent No.: US 6,481,246 B1
(45) Date of Patent: Nov. 19, 2002

(54) DRAIN PUMP MOUNTED PRESSURE SWITCH FOR A WASHING MACHINE

(75) Inventors: Troy A. Johnson, Newton, IA (US); Evan R. VandeHaar, Pella, IA (US); Russell L. VanNorden, Reasnor, IA (US); Ted L. Hansen, North Liberty, IA (US)

(73) Assignee: Maytag Corporation, Newton, IA (US)

( * ) Notice: Subject to any disclaimer, the term of this patent is extended or adjusted under 35 U.S.C. 154(b) by 189 days.

(21) Appl. No.: 09/619,100

(22) Filed: Jul. 19, 2000

(51) Int. Cl.[7] ..... D06F 33/02

(52) U.S. Cl. ..... 68/12.05; 68/12.02; 68/12.21; 68/207

(58) Field of Search ..... 68/12.02, 12.04, 68/12.05, 12.21, 207; 137/387

(56) References Cited

U.S. PATENT DOCUMENTS 1,832,906 A * 11/1931 Johnstone
2,001,661 A * 5/1935 Ball
2,133,708 A * 10/1938 Larson
2,203,828 A * 6/1940 Larson
3,060,713 A * 10/1962 Burkall
4,203,462 A 5/1980 Beller ..... 137/393
5,345,637 A * 9/1994 Pastryk et al.
5,881,578 A 3/1999 Proppe et al. ..... 68/12.202
5,964,001 A 10/1999 Johnson ..... 8/158

* cited by examiner

*Primary Examiner*—Frankie L. Stinson
(74) *Attorney, Agent, or Firm*—McKee, Voorhees & Sease, P.L.C.

(57) ABSTRACT

The air pressure sensor of the present invention functions to control the water level in a washing machine tub and to vary the fill volume relative to the clothes load. The sensor or switch is mounted on the drain pump on the base of the washing machine cabinet, so as to be independent from the washing machine tub. An air dome extends between the switch and the water inlet line of the pump. The switch is set to be actuated at a predetermined pressure. As the water level increases in the tub, the air pressure within the air dome increases, until eventually the switch is actuated. The switch is mounted directly to the air dome in an angular orientation, thereby minimizing or eliminating condensation problems in the switch. The switch will also be activated by water pressure, in the event of an air leak in the air dome, so as to preclude water overflow of the tub.

23 Claims, 2 Drawing Sheets

DRAIN PUMP MOUNTED PRESSURE SWITCH FOR A WASHING MACHINE

BACKGROUND OF THE INVENTION

The present invention relates to a method and apparatus for controlling the liquid level in a washing machine.

A typical washing machine controls the water fill level of the tub by use of an air dome, including a pressure switch in communication with a sealed tube. The open end of the tube is in communication with the bottom of the wash tub and extends upward toward the pressure switch. As water enters the wash tub and the sump, water enters the opening of the air dome hose and, as the water level rises, the air pressure in the sealed tube increases and ultimately trips the pressure switch. When the pressure switch trips, the washing machine stops filling. One example of a typical air dome is disclosed in U.S. Pat. No. 3,397,716.

One major problem with prior art air domes occurs when water enters the air dome hose. When water does enter the air dome hose, the water does not always come out due to the vacuum caused by the sealed hose. When this happens, the fill level of the washing machine increases since a greater fill level is required to trip the pressure switch. The fill level required to trip the pressure sensor will increase by an amount equal to the length of the water column trapped in the air dome hose. In other words, if six inches of water are trapped in the air dome hose, the level at which the washing machine will quit filling is increased by six inches. It is possible that the increased fill level will cause the washing machine to overflow.

A common way that water becomes trapped in the air dome hose is when a small amount of water is left in the sump at the bottom of the wash tub. possible that the increased fill level will cause the washing machine to overflow.

A common way that water becomes trapped in the air dome hose is when a small amount of water is left in the sump at the bottom of the wash tub. When the washing machine is tipped, for moving or maintenance for example, water will flow into the hose and will not come out. When this happens, the next time the washing machine is filled, the water level required to trip the pressure switch will be greater by an amount equal to the amount of water trapped in the air dome hose.

Another problem associated with prior art air dome hoses, such as that disclosed in U.S. Pat. No. 5,964,001, is the formation of condensation in the small diameter tube extending between the air dome and the pressure switch. Such condensation forms as a result of changes in the water temperature from hot to cold. Such condensation is hard to drain from the small diameter tube due to surface tension. Eventually, the condensation can migrate upwardly along the tube to the switch, and cause failure of the switch.

Another problem can arise if the pressure switch is mounted above the tub, as in the '001 patent. If there is a leak in the air dome, there will be no change in air pressure within the dome in response to changing water levels. Therefore, the switch will not actuate, leading to overflow of the washing machine tub.

Accordingly, a primary objective of the present invention is the provision of a pressure switch for controlling the water level in a washing machine without the problems associated with the prior art.

Another objective of the present invention is the provision of an air dome pressure switch which is mounted to the drain pump of the washing machine.

Another objective of the present invention is the provision of a pressure switch which is mounted below the tub so as to be actuated by water pressure in the event of an air leak in the air dome.

A further objective of the present invention is the provision of a pressure switch which is mounted adjacent the air dome so as to minimize or preclude formation of condensation.

Another objective of the present invention is the provision of a sensor for controlling water level in a washing machine tub, which is mounted independently of the tub.

A further objective of the present invention is the provision of a sensor for controlling water level in a washing machine, which is economical to manufacture, and effective and durable in use.

These and other objectives will become apparent from the following description of the invention.

SUMMARY OF THE INVENTION

The water level control pressure switch of the present invention is mounted to the drain pump of a washing machine, independently of the washing machine tub. An air dome extends from the water inlet line of the pump, so as to be partially filled with water during the fill cycle of the washing machine. The pressure switch is mounted directly to the air dome. The switch is angularly disposed to allow condensation to drain away from the switch. Since the pressure switch is mounted to the drain pump below the tub of the washing machine, in the event of an air leak in the air dome, the switch will still be actuated by water pressure, thereby preventing overflow of the tub. The pump housing, pump inlet, pump outlet, and air dome are integrally formed.

DETAILED DESCRIPTION OF THE DRAWINGS

Figure 2:
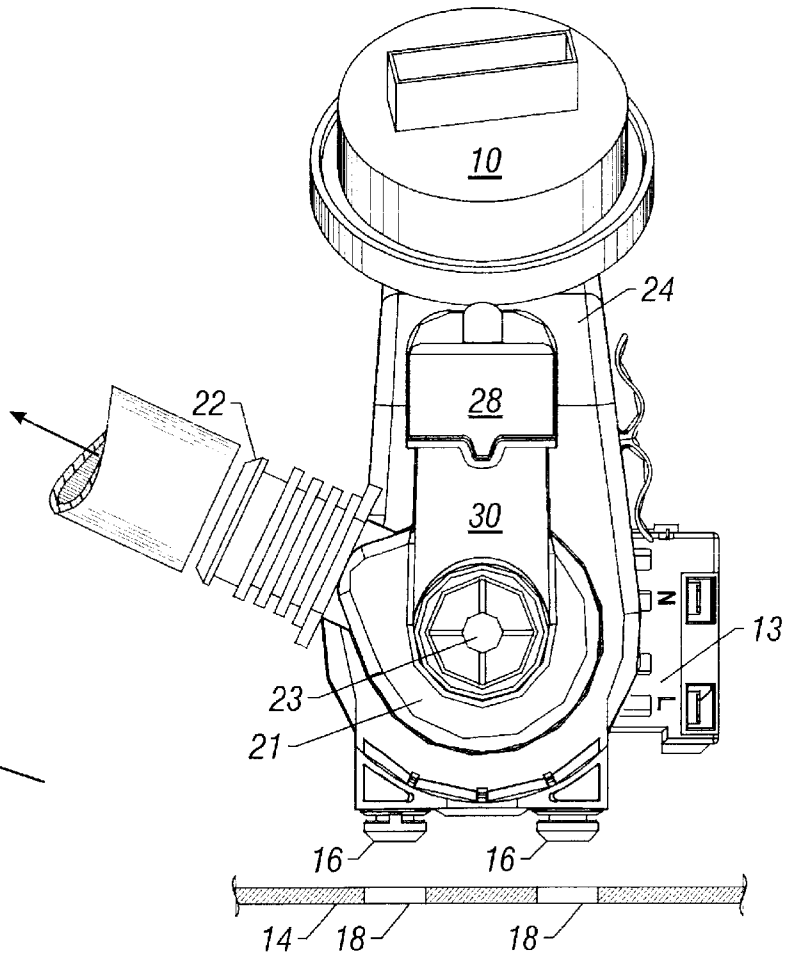
FIG. 2 is an end view of the switch and pump assembly.
Figure 1:
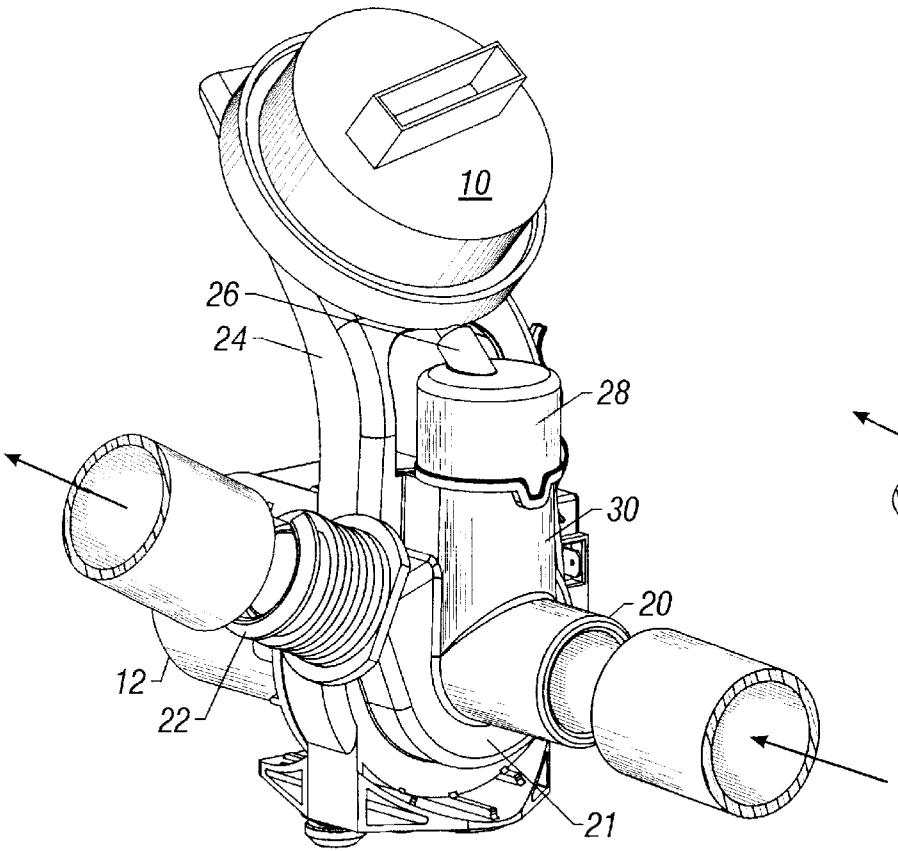
FIG. 1 is a perspective view of the pressure switch of the present invention mounted upon a drain pump of a washing machine.
Figure 4:
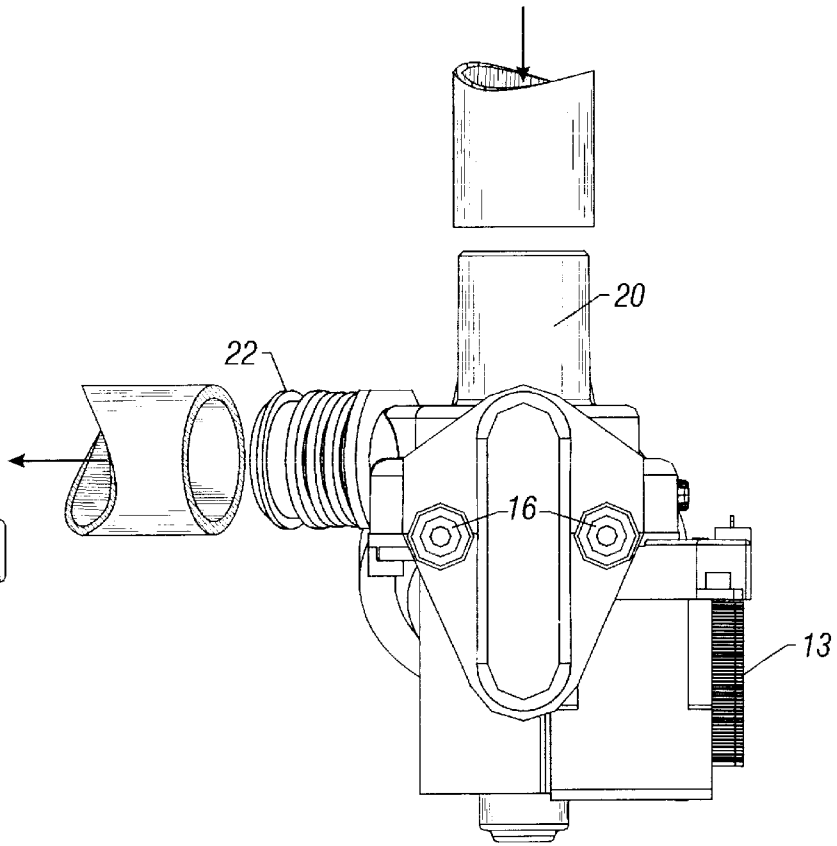
FIG. 4 is a bottom plan view of the pump and switch assembly.
Figure 3:
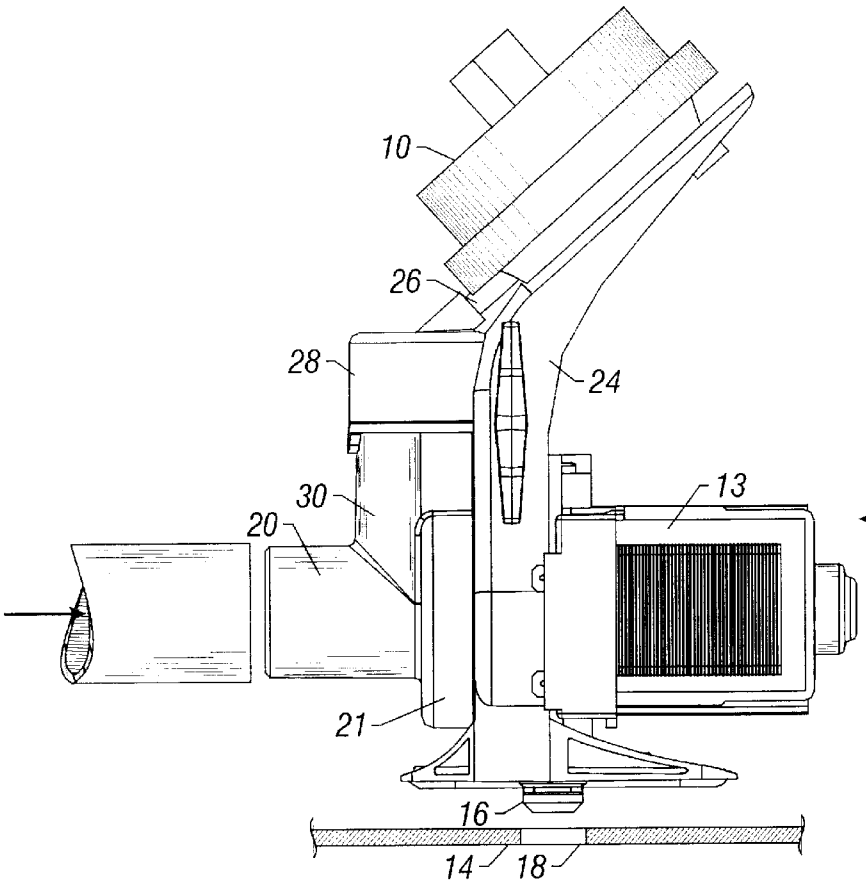
FIG. 3 is a side elevation view of the pump and switch assembly.

The present invention is directed towards a sensor or pressure switch 10 adapted to control the water level in a washing machine tub. The switch 10 is mounted upon the drain pump 12 of the washing machine. The pump 12 is secured to the base 14 of the washing machine cabinet (not shown). The pump 12 includes a plurality of feet 16 adapted to extend through keyholes 18 in the base 14 and twist lock to secure the pump 12 to the base 14. The pump 12 includes a water inlet line 20 and a water outlet line 22. A motor 13 is operatively connected to the circuitry of the washing machine to control operation of the pump 12. The pump 12 includes a housing 21 and an impeller 23.

The switch 10 is angularly mounted upon a support bracket 24. The switch 10 includes an air inlet 26 which is connected to a cap 28 on a stand pipe 30. Preferably, the support bracket 24, stand pipe 30, pump inlet 20, pump outlet 22 and pump housing 21 are integrally formed of molded plastic. The feet 16 may also be integrally formed with the housing 21. The stand pipe 30 has a relatively large diameter and is in fluid communication with the water inlet line 20 of the pump 12, so as to be partially filled with water during the fill cycle of the washing machine. The stand pipe 30 functions as an air dome. The water inlet 20 of the pump 12 is connected to the water outlet opening of the washing machine tub, such that changes in water level within the tub produce a corresponding change of the air pressure within the air dome stand pipe 30. The air pressure changes are sensed by the switch 10, which is actuated so as to control the water level in the tub.

In operation, at the beginning of the wash cycle, the wash tub will begin filling with water. The pump 12 is not actuated during the water fill cycle. As the water level increases in the tub, the pressure of the air inside the air dome 30 increases in proportion to the water level, via water in the inlet 20 and stand pipe 30. When the air pressure reaches a predetermined level, as sensed by the switch 10, the switch is actuated to stop the flow of water into the tub.

The relatively large diameter of the stand pipe 30 minimizes or precludes the formation of condensation resulting from changing water temperatures in the inlet 26 of the switch 10. Also, the angular orientation of the switch 10 on the bracket 24 allows any condensation which forms to drain from the air inlet 26.

If an air leak develops in the stand pipe or air dome 30, for example, from a failed seal between the cap 28 and the stand pipe or air dome 30, water pressure in the inlet line 20 and stand pipe 30 will eventually actuate the switch 10, since the switch 10 is located beneath the tub. Preferably, the switch 10 is a diaphragm-type switch, with the electrical contacts being on the opposite side of the diaphragm from the air inlet 26, such that in the event of an air leak, water will not damage the switch.

In conventional horizontal axis washing machines, the tub is hung from the cabinet and floats upwardly and downwardly in response to the load in the tub. Since the sensor or pressure switch 10 of the present invention is mounted to the drain pump 12 on the base 14 of the cabinet, movement of the tub due to varying clothes loads provides a relative difference in height between the tub and air dome 30, therefore varying the air pressure within the air dome 30. Accordingly, as the tub drops with a heavier load of laundry, the pressure in the air dome 30 is reduced, causing the pressure switch 10 to be actuated later so as to provide additional water in the tub for the larger load. Conversely, with the light load, the tub remains at a higher elevation, such that the switch will be activated earlier, thereby providing less water to a lighter laundry load. Thus, varying water levels are provided within the tub depending upon the load size, with the present invention functioning as a load sensor.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A pressure switch assembly for controlling water level in a washing machine, the machine including a cabinet with a base, a tab mounted in the cabinet, a drain pump with a water inlet line in fluid communication with the tub and a water outlet line for discharging water from the tub, the assembly comprising:

an air dome in fluid communication with the inlet line of the pump;

a pressure switch mounted directly on the air dome and being in fluid communication therewith so as to sense air pressure in the air dome.

2. The assembly of claim 1 wherein the pressure switch includes an air inlet connected to the air dome.

3. The assembly of claim 1 wherein the pressure switch is angularly disposed relative to the air dome to allow condensation to drain from the pressure switch.

4. The assembly of claim 1 wherein the pressure switch is mounted independently of the tub.

5. The assembly of claim 1 wherein the washing machine includes a cabinet with a base, and the pressure switch is mounted to the base.

6. A device for controlling water level in a washing machine having a wash tub and a pump with an inlet and outlet for draining water from the tub, comprising:

an air pressure sensor mounted on the pump;

an air dome disposed between the air pressure sensor and the pump inlet so that the air pressure sensor senses air pressure changes in the air dome resulting from water level changes in the tub.

7. The device of claim 6 wherein the air pressure sensor is mounted independently of the tub.

8. The device of claim 6 wherein the air pressure sensor includes an air inlet connected directly to the air dome.

9. The device of claim 8 wherein the air inlet extends downwardly from the air pressure sensor to preclude migration of condensation to the air pressure sensor.

10. A pump and air dome assembly for controlling water level in a washing machine, comprising:

a pump housing;

a water inlet leading to the pump housing;

a water outlet directed away from the pump housing;

an air dome formed on the water inlet;

an air pressure sensor connected to the air dome for sensing air pressure within the air dome; and a support bracket extending from the pump housing for mounting the air pressure sensor.

11. The assembly of claim 10 wherein the pump housing, water inlet, water outlet, air dome and support bracket are integrally formed.

12. The assembly of claim 10 wherein the pump housing, water inlet, water outlet and air dome are integrally formed.

13. A pressure switch assembly for controlling water level in a washing machine, the machine including a cabinet with a base, a tub mounted in the cabinet, a drain pump with a water inlet line in fluid communication with the tub and a water outlet line for discharging water from the tub, the assembly comprising:

an air dome in fluid communication with the inlet line of the pump;

a pressure switch mounted on the air dome and being in fluid communication therewith so as to sense air pressure in the air dome; and the pressure switch including an air inlet connected to the air dome.

14. The assembly of claim 13 wherein the pressure switch is angularly disposed relative to the air dome to allow condensation to drain from the pressure switch.

15. The assembly of claim 13 wherein the pressure switch is mounted independently of the tub.

16. The assembly of claim 13 wherein the washing machine includes a cabinet with a base, and the pressure switch is mounted to the pump.

17. A pressure switch assembly for controlling water level in a washing machine, the machine including a cabinet with a base, a tub mounted in the cabinet, a drain pump with a water inlet line in fluid communication with the tub and a water outlet line for discharging water from the tub, the assembly comprising:

an air dome in fluid communication with the inlet line of the pump;

a pressure switch mounted adjacent on the air dome and being in fluid communication therewith so as to sense air pressure in the air dome; and the pressure switch being angularly disposed relative to the air dome to allow condensation to drain from the pressure switch.

18. The assembly of claim 17 wherein the pressure switch is mounted directly on the air dome.

19. The assembly of claim 17 wherein the pressure switch including an air inlet connected to the air dome.

20. The assembly of claim 17 wherein the pressure switch is mounted independently of the tub.

21. The assembly of claim 17 wherein the washing machine includes a cabinet with a base, and the pressure switch is mounted to the pump.

22. A pump and air dome assembly for controlling water level in a washing machine, comprising;

a pump housing;

a water inlet leading to the pump housing;

a water outlet directed away from the pump housing;

an air dome formed on the water inlet;

an air pressure sensor connected to the air dome for sensing air pressure within the air dome; and the pump housing, water inlet, water outlet and air dome being integrally formed.

23. The assembly of claim 22 further comprising a support bracket extending from the pump housing for mounting the air pressure sensor.

* * * * *